United States Patent [19]

Schoop et al.

[11] 4,190,238

[45] Feb. 26, 1980

[54] LANCE HEAD FOR A FINING LANCE

[75] Inventors: Josef Schoop, Peine; Werner Resch, Dortmund; Heinz Damme, Peine, all of Fed. Rep. of Germany

[73] Assignee: Stahlwerke Peine-Salzgitter AG, Fed. Rep. of Germany

[21] Appl. No.: 905,007

[22] Filed: May 11, 1978

[51] Int. Cl.[2] ..... C21C 5/48

[52] U.S. Cl. ..... 266/270; 75/60

[58] Field of Search ..... 266/270; 75/60

[56] References Cited

U.S. PATENT DOCUMENTS

| | | | |
|---|---|---|---|
| 3,337,204 | 8/1967 | Gigantino | 75/60 |
| 3,488,044 | 1/1970 | Shepherd | 75/60 |
| 3,567,202 | 3/1971 | Mercatoris | 75/60 |
| 3,638,932 | 2/1972 | Masella | 75/60 |
| 3,661,560 | 5/1975 | Grenfell | 75/60 |
| 3,697,058 | 10/1972 | Chaikin | 75/60 |
| 3,901,445 | 8/1975 | Chang | 75/60 |

*Primary Examiner*—P. D. Rosenberg
*Attorney, Agent, or Firm*—McGlew and Tuttle

[57] ABSTRACT

A lance head for a refining lance, comprising, a lance head bottom member, a plurality of expanding nozzles connected to the bottom member, a supply line associated with the bottom member for supplying coolant thereto, a return line associated with the supply line for channeling coolant away from the bottom member and a flow guide member connected between the supply line and the return line. The flow guide member extends across the plurality of expanding nozzles and includes a surface facing the bottom member defining a coolant passage therewith. The flow guide member surface is concave in the area of the nozzles so that the cross-sectional area of the flow passage is constant as coolant flows past the nozzles. The edge of the flow guide member surface extends beyond the nozzles and at an oblique angle to a central portion of the bottom member between the nozzles. The flow guide member includes a top surface and a distributor member is mounted in the lance head at a location spaced from the top surface of the flow guide member. The top surface of the flow guide member and the distributor member define a second coolant passage through which coolant passes into the return line from the aforementioned coolant passage. The top surface of the flow guide member is convex and the surface of the distributor member is concave to define a smooth curved second coolant passage which returns coolant to the return line without turbulence and under low resistance.

9 Claims, 1 Drawing Figure

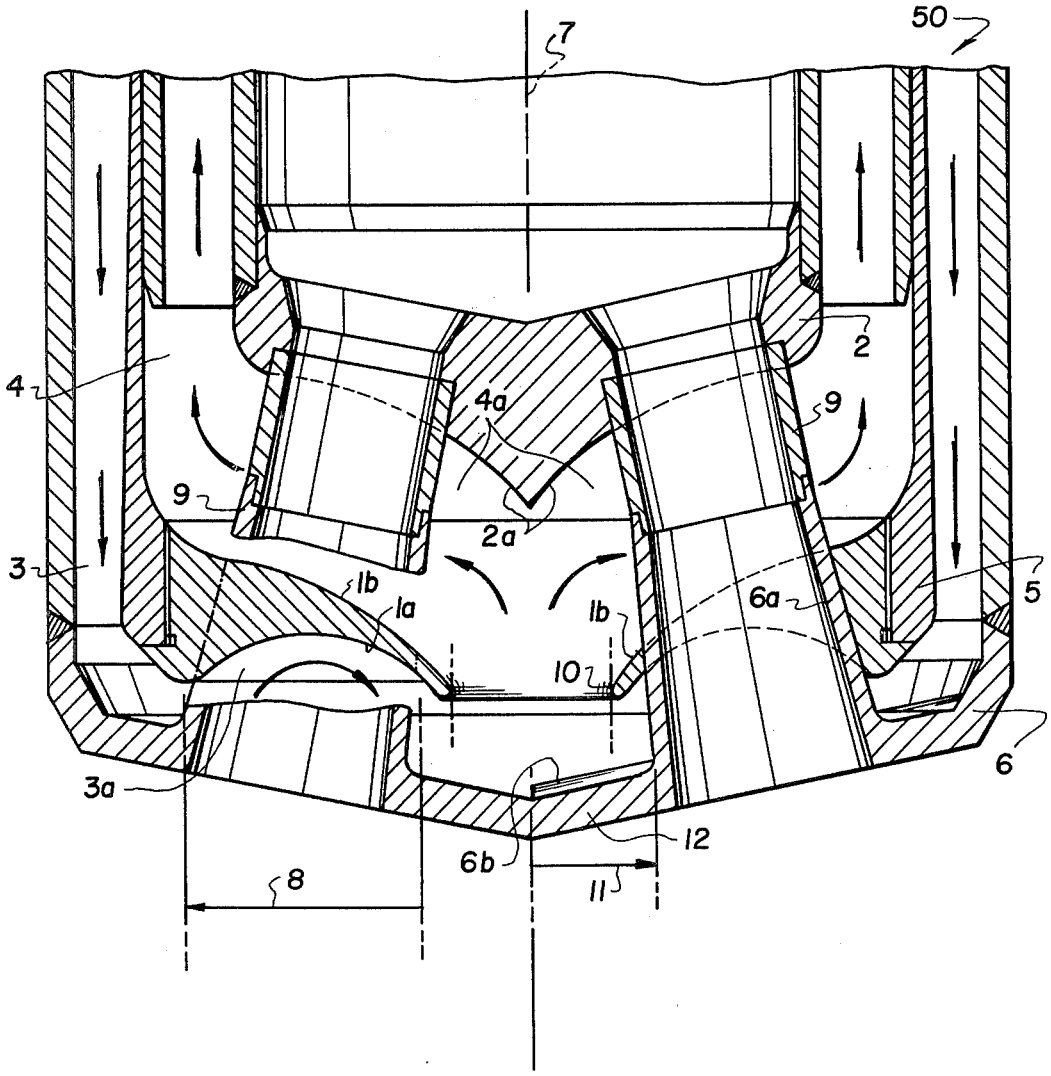
50
7
2
4
4a
9
9
2a
3
1b
1a
1b
6a
5
10
6
3a
12
6b
11
8

LANCE HEAD FOR A FINING LANCE

FIELD AND BACKGROUND OF THE INVENTION

The present invention relates in general to a lance head for refining lances and, in particular, to a new and useful lance head, comprising a plurality of expanding nozzles which are directed toward a bottom surface of the lance head and diverge from the longitudinal axis thereof, and at least one supply line and one return line for coolant, which lines extend concentrically of the longitudinal axis and between which a flow guide device for cooling the lance head is provided.

DESCRIPTION OF THE PRIOR ART

Lance heads for oxygen blowing lances are known and have proven to be excellent in practice for various metallurgical methods, such as the LD, LDAC, LDS, SM and the electric-furnace methods as well. One problem of the refining process, however, which leads to considerable repair costs due to the necessity of procuring and mounting spare heads, still remains to be solved in a satisfactory manner. This problem is the short-lived functionality of lance heads in use at present and concerns the extension of this useful life to an acceptable length. The majority of heads are destroyed by a burning-through effect in the central area of the head between the nozzles after only a short period of service. These central breakdowns are dangerous, since the cooling water which is under high pressure is injected through the ruptures into the liquid steel bath where it may cause oxyhydrogen explosions.

It is well known that in a refining process, temperatures up to 2273 K. (2000° C.) occur in the zone of the lance head. Copper, which is used in these heads, by comparison, has a melting temperature of about 1356 K. (1083° C.). The heat energy to which the outer surface of the lance head is exposed must thus be conducted into the interior of the head and dissipated by means of a coolant, for example, cooling water. Many patents are known which contain proposals for solving the difficult problem of suitable coolant guidance within the lance head to obtain an optimum of cooling effect. Experience in steel workds has shown, however, that this prior art is unsatisfactory and none of the hitherto known solutions has resulted in sufficient prolongation of the life of lance heads.

It has been found that in the prior art refining lances of the type mentioned above, means for guiding the coolant within the lance head do not meet the requirements of fluid mechanics to an extent sufficient to ensure a satisfactory cooling of those areas of the lance head which are exposed to maximum thermal stresses.

Even though, in principle, the objective of directing the coolant against the center of the lance head has been attained, the desired cooling effect could not be produced, inter alia, because of the formation of turbulence and dead water spaces, since the means for guiding the water have not been designed to comply with the mentioned requirements. For example, rings for guiding the coolant in the lance head have been provided without taking into account, as far as these rings did surround the nozzles at all, the hydrodynamically important aspect of the varying cross-sectional areas between the individual adjacent nozzles.

In other lance heads of the prior art, the guide rings terminate short of the peripheral line tangenting the nozzles near the center of the head. Alternatively, circular ring segments of various shapes are provided within the lance head which not only does not prevent the formation of undesirable turbulences, but actually enhance such formation. This necessarily leads to an unsatisfactory cooling, particularly of the central, thermally highly stressed area of the lance head, resulting in a destruction of the lance head due to the melting of the copper after a very short time. The lance head thus becomes unusable prematurely, with the result of frequent interruptions of the operation and production. In addition, the hazard of accidents is increased due to a possible formation of oxyhydrogen gas ($H_2O$ cracking), as mentioned previously herein.

SUMMARY OF THE INVENTION

The purpose of the present invention is to largely eliminate the above-described drawbacks of the prior art lance heads and to obtain a more satisfactory cooling of the thermally highly stressed areas of the lance head and to ensure a prolonged life and safety in operation of the heads by designing the cooling zone so as to best comply with the hydrodynamic requirements imposed on a lance head cooling system.

In accordance with the invention, a lance head for refining lances is provided which comprises a plurality of expanding nozzles which diverge from the longitudinal axis and which are directed toward the bath surface, and at least one supply line and one return line for the coolant which extend concentrically of the longitudinal axis and between which a flow guide device for cooling the lance head and deflecting the coolant flow is disposed. The solution to the aforementioned problem is achieved in accordance with the invention in that, at a location spaced from the lance head bottom plate, a flow guide member is mounted adjacent the tube forming the boundary between the supply and return lines, which extends in the direction of the longitudinal axis and which has a concave surface facing the bottom plate in the radial zone occupied by the expanding nozzles which narrow the cross-section of this zone.

In view of the concave shape of the flow guide member, the sectional area of coolant flow passage between every two adjacent expanding nozzles grows narrower in the horizontal plane. This narrowing is proportionally compensated in the vertical plane to obtain a constant sectional area of flow. The curvature of the concavity can thus be exactly calculated to cause this constant cross-sectional area of the coolant passage.

In consequence, and in accordance with the invention, the flow velocity of the coolant becomes uniform over the entire free inside surface of the lance head bottom, which ensures that a film evaporation, reducing the solid-liquid heat transfer and, as has been found, casually linked to the premature melting of the copper in the central zone of the lance head bottom, is largely prevented.

This function is further enhanced by the inventive structure of the flow guide member by providing that the rim portion terminating the flow guide member on the inside thereof extends at least up to a circular line or tangent limiting the expanding nozzles at the inside and, in conformity with the concave shape, obliquely relative to the central front face, whereby, the coolant is positively directed against the thermally highly stressed central portion of the lance head bottom between the nozzles.

The low resistance return flow of the coolant is also closely connected to the advantageous function of the inventive lance head. This is also important for the optimal effect of the cooling. In this regard, in accordance with the invention, the upper surface of the flow guide member, forming the boundary for the coolant return flow, is of a convex shape and this convex surface conforms approximately to the concave surface of a distributor member positioned above the flow guide member.

The sectional area of flow passage between the distributor member of concave shape and the convex surface of the flow guide member is at least as large as the sectional area of flow below the flow guide member. Experience has shown that while exactly observing the present teaching of the invention, the spaces for the coolant flow can be located with such perfection that the coolant supply and return may be provided in an opposite direction with a full cooling effect.

Accordingly, it is an object of the invention to provide a lance head for a refining lance, comprising, a lance head bottom member, a plurality of expanding nozzles connected to said bottom member, a supply line associated with said bottom member for supplying coolant thereto, a return line associated with said supply line for channeling coolant away from said bottom member, a flow guide member connected between said supply line and said return line extending across said nozzles for directing coolant toward and across said bottom member, said flow guide member having a bottom surface facing said bottom member and defining a first coolant passage therewith, said flow guide member bottom surface being concave in the area adjacent said nozzles and the cross-sectional area of said first coolant passage being substantially constant past said nozzles due to said concavity, whereby, coolant is uniformly directed past said bottom member.

A further object of the invention is to provide a lance head wherein the flow guide member has a top convex surface and the lance head further includes a distributor member having a concave bottom surface, said distributor member bottom surface and said flow guide top surface defining a second coolant passage through which coolant passes after it passes through said first coolant passage, whereby, coolant is channeled away from said bottom member at low pressure and without turbulence.

Another object of the invention is to provide a lance head for a refining lance which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

BRIEF DESCRIPTION OF THE DRAWING

The only FIGURE of the drawing is a sectional side elevational view of a lance head for a refining lance constructed in accordance with the invention.

DESCRIPTION OF THE PREFERRED EMBODIMENT

Referring now to the drawing in particular, the invention embodied therein, comprises a lance head, generally designated 50, for a fining lance, which includes an outer annular supply line 3 and a concentrically disposed inner annular return line 4. Coolant flows through supply line 3 into a first coolant passage 3*a* and then in a direction of the arrows into a second coolant passage 4*a* and finally into the return line 4.

A flow guide member 1 which has a bottom surface 1*a* facing the interior surface of a lance head bottom member 6 and defining therewith the first coolant passage 3*a* is connected between the supply line and return line. Flow guide member 1 includes a top surface 1*b* which defines the second coolant passage 4*a* with a bottom surface 2*a* of a distributor member 2. A plurality, in this case four, of expanding nozzles 9 are divergently disposed around the major axis 7 and include an intermediate portion 6*a* which connects the nozzles to the lance head bottom member 6. Flow guide member 1 extends radially across the nozzles 9, 6*a* and the nozzles 9, 6*a* reduce the cross-sectional area of the first coolant passage 3*a*. The cross-sectional area of the first coolant passage 3*a* is maintained constant by providing that the bottom surface 1*a* of the flow guide member is concave in the area adjacent the nozzles 9. This area is designated by a radial zone 8.

The flow guide member 1 is connected to a tube or tube length 5 separating the coolant supply line 3 from the coolant return line 4. The flow guide member 1 may be secured to tube 5 in a manner known per se by any means, for example, by welding, brazing, clamping, cementing or the like, or by resilient connecting elements.

A rim portion or end 10 terminating flow guide member 1 on its inside edge, extends beyond the circular line 11 limiting or tangenting expanding nozzles 9, 6*a* in the inside or central direction and deflects the coolant to the central surface or portion 12 of lance head bottom member 6. The convex surface 1*b* of flow guide member 1 is approximately conforment to the concave surface 2*a* of distributor member 2, whereby, a disturbance and turbulance-free, low resistance return of the coolant is ensured in the second passage 4*a*.

In order to obtain a satisfactory flow of the coolant, it is necessary to carefully seal flow guide member 1 relative to expanding nozzles 9. For sealing, for example, a non-detachable connection, such as brazing, welding, or the like, may be provided, or detachable sealing elements, such as elements made of a permanently resilient material like elastomers in the form of thermoplastics or duroplastics may be used. Bottom member 6 may include ribs 6*b* or the like to increase its surface area and enhance cooling thereof.

In practice, tests of the inventive lance heads have shown that the life of the fining lance manufactured in accordance with the invention can be considerably extended beyond that of the lances of the prior art, so that aside from a measurably improved economy, accident hazards connected to central breakdowns are substantially reduced.

While a specific embodiment of the invention has been shown and described in detail to illustrate the application of the principles of the invention, it will be understood that the invention may be embodied otherwise without departing from such principles.

What is claimed is:

1. A lance head for a refining lance, comprising, a lance head bottom member, a plurality of nozzles connected to said bottom member, a supply line connected to said bottom member for supplying coolant toward an inner surface thereof, a return line connected to said supply line for channeling coolant away from the interior surface of said bottom member, said supply and return lines disposed concentrically of a major axis of said lance head, a flow guide member connected between said supply line and said return line extending inwardly toward the major axis of said lance head and closely around said nozzles for directing coolant toward and across said bottom member interior surface, said flow guide member having a bottom surface facing said bottom member interior surface and defining a first coolant passage therewith, said flow guide member bottom surface being concave toward said interior surface in the area adjacent said nozzles and the cross-sectional area of said first coolant passage being substantially constant past said nozzles due to said concavity, whereby, coolant is uniformly directed past said bottom member interior surface.

2. A lance head, as claimed in claim 1, wherein said plurality of nozzles are disposed about the major axis of the refining lance and at an angle diverging from the major axis in the direction of said lance head bottom member, said supply line and said return line comprising annular concentric passages about the major axis, said lance head bottom member further including a central portion defined by a circular line tangenting said nozzles adjacent said major axis, said flow guide member extending past said expanding nozzles at least to said central portion of said bottom member, and said concave bottom surface of said flow guide member terminating at an oblique angle relative to said central portion, whereby, coolant is channeled uniformly across said bottom member and directed toward said central portion.

3. A lance head, as claimed in claim 1, further including a distributor member connected to said return line and having a bottom concave surface, said flow guide member having a top convex surface spaced from said bottom concave surface of said distributor member and defining therewith a second coolant passage contiguous with said first coolant passage, coolant flowing sequentially through said supply line, said first coolant passage, said second coolant passage and said return line, said concavity of said distributor member bottom surface substantially corresponding to said convexity of said flow guide member top surface whereby coolant flows through said second coolant passage without turbulence and at reduced pressure.

4. A lance head, as claimed in claim 3, wherein the cross-sectional area of said second coolant passage is at least as large as the cross-sectional area of said first coolant passage.

5. A lance head, as claimed in claim 1, wherein the coolant is supplied in the reverse direction from said return line to said supply line.

6. A lance head, as claimed in claim 2, further including a tube connected adjacent said supply line and extending it, said flow guide member connected to said tube by at least one of welding, brazing, clamping, cementing, and applying a resilient connecting element.

7. A lance head, as claimed in claim 2, wherein said lance head bottom member further includes ribs whereby a surface area on said bottom member for cooling is enlarged.

8. A lance head, as claimed in claim 1, wherein said flow guide member is connected to said nozzles by a resilient material.

9. A lance head, as claimed in claim 1, wherein said flow guide member is sealed to said nozzles rigidly.

* * * * *